United States Patent [19]

Rex

[11] 4,008,871

[45] Feb. 22, 1977

[54] SHOWROOM WINDOW DISPLAY HANGER

[75] Inventor: Roger F. Rex, Hales Corners, Wis.

[73] Assignee: Display Corporation International, Milwaukee, Wis.

[22] Filed: Jan. 15, 1976

[21] Appl. No.: 649,240

[52] U.S. Cl. ..... 248/205 A; 248/290; 248/304

[51] Int. Cl.[2] ..... A47B 96/06; A47F 5/00

[58] Field of Search ..... 211/96, 105.1, 105.2, 211/106; 248/205 R, 205 A, 289, 290, 302, 303, 304

[56] References Cited

UNITED STATES PATENTS

| | | | |
|---|---|---|---|
| 203,241 | 5/1878 | Bovey | 211/96 |
| 2,625,378 | 1/1953 | Nason | 248/205 A UX |
| 3,094,811 | 6/1963 | Feezel | 248/205 R X |
| 3,180,607 | 4/1965 | Lee | 248/205 A X |
| 3,918,668 | 11/1975 | Thorpe | 248/205 A |

FOREIGN PATENTS OR APPLICATIONS

| | | | |
|---|---|---|---|
| 1,213,698 | 11/1959 | France | 211/96 |
| 1,947,393 | 8/1971 | Germany | 248/205 A |

*Primary Examiner*—Lawrence J. Staab

[57] ABSTRACT

A display hanger has a base including a plate and two laterally spaced adhesive pads for attachment to a window surface. The plate and adhesive pad partially define a supporting channel, the supporting channel being completed when the pads are attached to the window surface. A bracket has an extended arm and a leg perpendicular thereto, the leg being held within the supporting channel so that the extended arm extends laterally from the window surface to support a hanging banner.

5 Claims, 4 Drawing Figures

SHOWROOM WINDOW DISPLAY HANGER

BACKGROUND OF THE INVENTION

I. Field of the Invention

The invention relates generally to display hangers and, more particularly, to a showroom window display hanger suitable for supporting a hanging banner from a window surface.

II. Description of the Prior Art

Examples of typical hangers available in the prior art can be found in U.S. Patents Garrison, U.S. Pat. No. 327,939, St. Clair U.S. Pat. No. 2,926,824 and Janssen U.S. Pat. No. 3,637,181. None of these prior hangers were suitable for attachment to a glass window surface, or more generally, for facile and economical suspension of articles from support surfaces.

This invention is concerned with this general area and has among its objects to provide a simple, economical hanger which can be readily attached to a support surface to, in turn, support an article from that support surface and, more specifically, to provide such a hanger which is particularly well suited for use with a glass window as the support surface.

SUMMARY OF THE INVENTION

The invention provides a display hanger for supporting a hanging banner, or the like, from a support surface, preferably a window. The display hanger includes a base having a plate and two laterally spaced pads having adhesive surfaces for direct attachment to the support surface; the plate, adhesive pads and support surface define a supporting channel. A bracket having an extended arm and a leg generally perpendicular thereto is provided and has the leg held within that supporting channel while the laterally extended arm supports a hanging banner.

The leg can be constructed with dimensions so that it is removable from and rotatably held within the supporting channel to thereby permit the arm, and the banner, to assume a variety of angular positions relative to the plane of the support surface. Preferably, the leg is constructed with a generally circular cross-section so that it can be rotated within the supporting channel. The leg can also be constructed with a generally rectangular cross-section so that it cannot rotate within the supporting channel but is still removable from the channel.

DESCRIPTION OF THE PREFERRED EMBODIMENT

Figure 1:
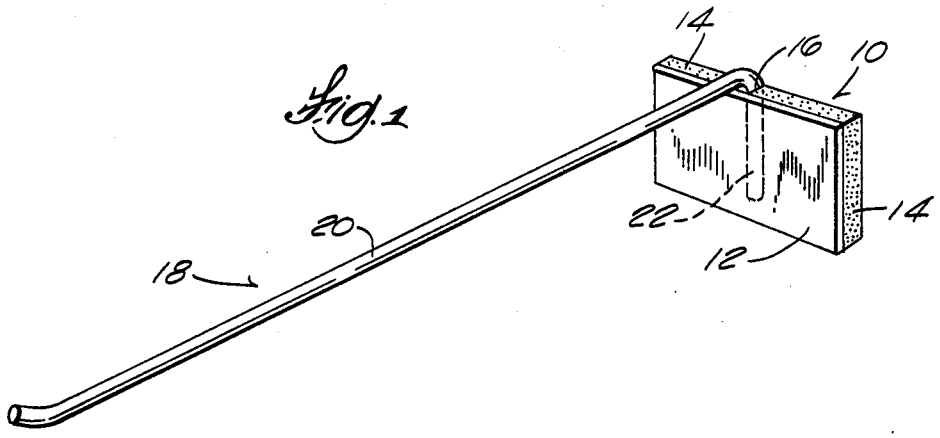
FIG. 1 is a perspective view of a showroom window display hanger embodying this invention.
Figure 2:
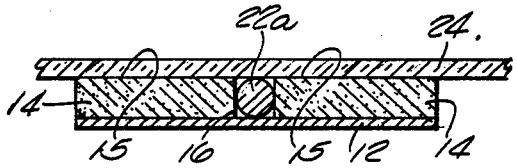
FIG. 2 is a top sectional view of the base of the showroom window display hanger as shown in FIG. 1, the base being secured to a window surface.
Figure 3:
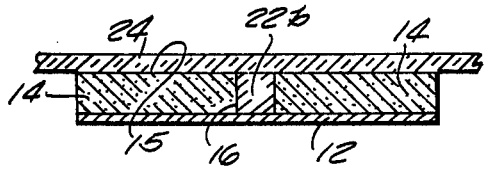
FIG. 3 is a top sectional view similar to FIG. 2 illustrating another embodiment of the invention.
Figure 4:
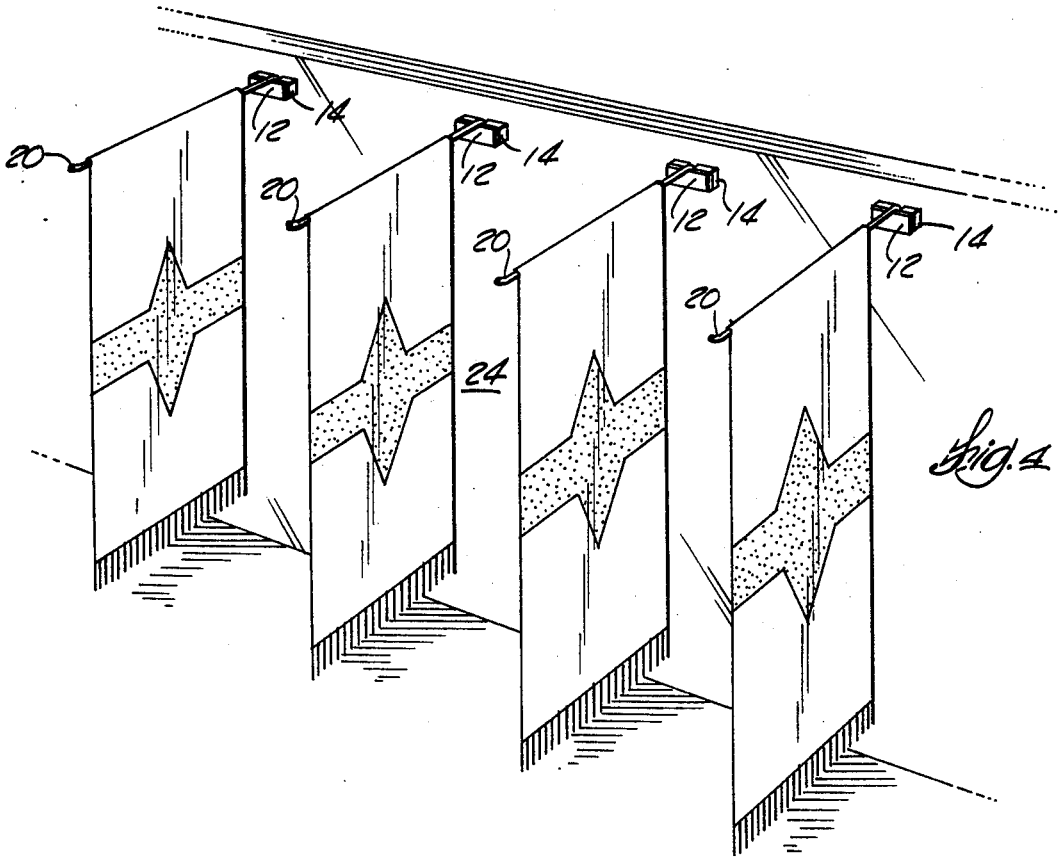
FIG. 4 is a perspective view of several showroom window display hangers shown in use for supporting hanging banners.

Referring more particularly to the drawings, wherein like numerals refer to like parts through the several views, FIG. 1 shows a base 10, having a plate 12 and two laterally spaced adhesive pads 14 for attachment to a window surface 24, see FIGS. 2–4. The adhesive pads 14 are preferably of a pressure sensitive type of conventional construction having adhesive surfaces 15 which adhere to a glass window surface to provide support for a lightweight display article such as a fabric or paper banner.

The plate 12 is a planar member and together with the laterally spaced adhesive pads 14 partially defines a supporting channel 16. A bracket 18 has an extended arm 20 and a leg 22 generally perpendicular thereto. The display hanger can be preassembled by securing the leg 22 to the plate 12 and adhesive pads 14. Preferably, the leg 22 is inserted and removably held within the supporting channel 16 after that channel is further defined by the window surface 24 when the adhesive pads 14 have been attached to the window surface at a desired position.

The leg 22 is preferably constructed with a circular cross-section **22*a*, as shown in FIG. 2, so that it is rotatable within the supporting channel 16. The extended arm 20 and attached display article can then be positioned at various angles with respect to the plane of the window surface 24. The leg 22 can also be constructed with a rectangular cross-section 22*b* completely filling the cross-section of the supporting channel, as shown in FIG. 3. With that construction, the extended arm 20 is held in nonrotatable relation within the supporting channel 16 and will be fixed generally perpendicular to the window surface 24**.

As illustrated in FIG. 4, after the base 10 has been attached to a window surface and bracket leg 22 inserted in support channel 16, a hanging banner or the like can be attached to the extended arm 20 by conventional means for display purposes.

It is to be understood that the invention is not confined to the particular construction and arrangement of parts herein illustrated and described, but embraces all such modified forms thereof as come within the scope of the following claims.

I claim:

1. A display hanger for supporting a hanging banner on a support surface, said hanger comprising:

a base having a planar plate and two laterally spaced adhesive pads connected to said plate and each having exposed adhesive surfaces for attachment to the support surface, said plate and laterally spaced adhesive pads partially defining a supporting channel, said supporting channel being completed by said support surface when said adhesive surfaces are attached thereto, and a bracket having an extended arm and a leg generally perpendicular thereto, said leg being held within said supporting channel so that said extended arm extends laterally from said support surface for support of a display member therefrom.

2. The display hanger of claim 1 wherein said leg is removably held within said supporting channel.

3. The display hanger of claim 1 wherein said leg has a generally circular cross-section and is rotatable within said supporting channel.

4. The display hanger of claim 1 wherein said leg has a generally rectangular cross-section and is held in nonrotatable relation within said supporting channel.

5. The display hanger of claim 1 wherein said support surface is a window.

* * * * *